US006449787B1

(12) United States Patent
Thorne

(10) Patent No.: US 6,449,787 B1
(45) Date of Patent: Sep. 17, 2002

(54) SLEEPING BAG

(76) Inventor: Heather N. Thorne, 2516 Pine St., Philadelphia, PA (US) 19103

( * ) Notice: Subject to any disclaimer, the term of this patent is extended or adjusted under 35 U.S.C. 154(b) by 0 days.

(21) Appl. No.: 09/715,241

(22) Filed: Nov. 17, 2000

Related U.S. Application Data

(60) Provisional application No. 60/166,550, filed on Nov. 19, 1999.

(51) Int. Cl.[7] ..... A47C 29/00
(52) U.S. Cl. ..... 5/413 R; 5/413 AM; 2/69.5
(58) Field of Search ..... 5/413 AM, 413 R; 2/69.5

(56) References Cited

U.S. PATENT DOCUMENTS

| | | | | | |
|---|---|---|---|---|---|
| 2,064,458 | A | | 12/1936 | Bulpit et al. | |
| 2,151,462 | A | | 3/1939 | Bulpit et al. | |
| 3,175,231 | A | | 3/1965 | Magario et al. | |
| 3,178,734 | A | | 4/1965 | Carrez | |
| 3,584,323 | A | | 6/1971 | Worley | |
| 3,787,906 | A | * | 1/1974 | Hunt | 5/413 R |
| 3,959,834 | A | * | 6/1976 | Hunt | 5/413 R |
| 4,354,281 | A | | 10/1982 | Satoh | |
| 4,513,461 | A | | 4/1985 | Tardival | |
| 4,605,029 | A | | 8/1986 | Russell | |
| 4,884,303 | A | * | 12/1989 | Scherer | 5/413 R |
| 4,894,878 | A | | 1/1990 | Roach | |
| 5,199,121 | A | | 4/1993 | Payne | |
| 5,343,578 | A | | 9/1994 | Kettenhofen | |
| 5,490,294 | A | | 2/1996 | Kramer | |
| 5,533,216 | A | | 7/1996 | Thier | |
| 5,640,725 | A | * | 6/1997 | Ando et al. | 5/413 AM |
| 5,657,497 | A | | 8/1997 | Howe | |
| 5,706,532 | A | | 1/1998 | Kettenhofen | |
| 5,887,299 | A | | 3/1999 | Phillips | |
| 5,966,756 | A | | 10/1999 | Cartier | |
| 6,018,830 | A | * | 2/2000 | Howe | 5/413 R |

* cited by examiner

*Primary Examiner*—Lynne H. Browne
*Assistant Examiner*—James M. Hewitt
(74) *Attorney, Agent, or Firm*—Kolisch Hartwell Dickinson McCormack & Heuser

(57) ABSTRACT

An adjustable-warmth sleeping bag. The sleeping bag typically includes an outer shell and a plurality of compartments filled with an insulative material. The sleeping bag also typically includes a plurality of slots positioned adjacent the outer shell, each slot containing a respective insulator. The insulators are typically configured to be selectively inserted and removed from the slots to vary the warmth of the bag.

18 Claims, 2 Drawing Sheets

SLEEPING BAG

CROSS-REFERENCE TO RELATED APPLICATION

This application claims the benefit of U.S. provisional patent application Serial No. 60/166,550, entitled "Sleeping Bag," filed on Nov. 19, 1999.

TECHNICAL FIELD

This invention relates generally to outdoor sleep products, and more particularly to sleeping bags.

BACKGROUND OF THE INVENTION

Sleeping bags are used in a wide variety of wilderness applications, including rock and ice climbing, camping, backpacking, fishing, mounting climbing, etc. These activities are carried on throughout the year in a range of climatic regions and weather conditions. Currently, sleeping bags are designed with a weight adapted for a particular season, such as summer weight, fall weight, winter weight, or for a particular temperature range, such as 5–15 degrees Fahrenheit, 15–30 degrees Fahrenheit, etc. Outdoor enthusiasts who wish to use a sleeping bag in both warm and cold environments presently are required to purchase a separate sleeping bag designed for each environment. Purchasing multiple sleeping bags is costly to the user and takes up storage space in the user's home.

It would be desirable to provide a sleeping bag configured to be adjustable to a range of insulation levels, such that a single sleeping bag may be used in both warm and cold conditions.

SUMMARY OF THE INVENTION

A sleeping bag is provided. Typically the sleeping bag includes an outer shell, a plurality of slots positioned adjacent the outer shell, each of the slots being configured to receive a respective insulator. Typically, each of the insulators may be inserted and removed selectively to adjust the warmth of the sleeping bag. The outer shell may have a plurality of compartments filled with an insulative material. In addition, the insulators each may be configured to be inserted into a respective slot using an insertion tool. Typically, the insulator includes a valve configured to receive the insertion tool, and the valve is configured to inhibit a filler material from exiting the insulator. The insulator includes an outer surface enclosing a filler material. The sleeping bag may be configured to transition between a light-insulation configuration, a medium-insulation configuration, and a heavy-insulation configuration by insertion and removal of the insulators.

DETAILED DESCRIPTION OF THE PREFERRED EMBODIMENT

Figure 1:
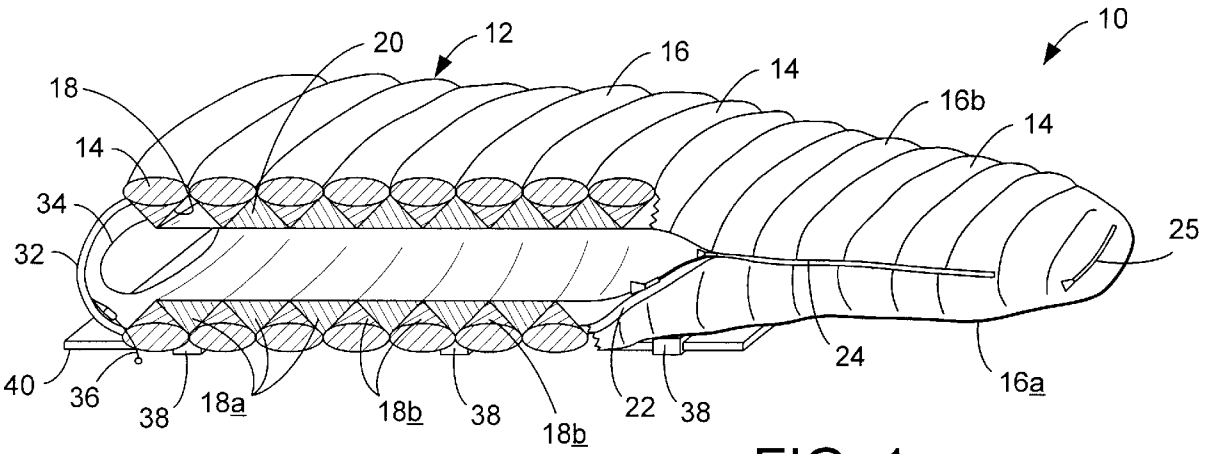
FIG. 1 is a partial cutaway isometric view of a sleeping bag according to the present invention.
Figure 2:
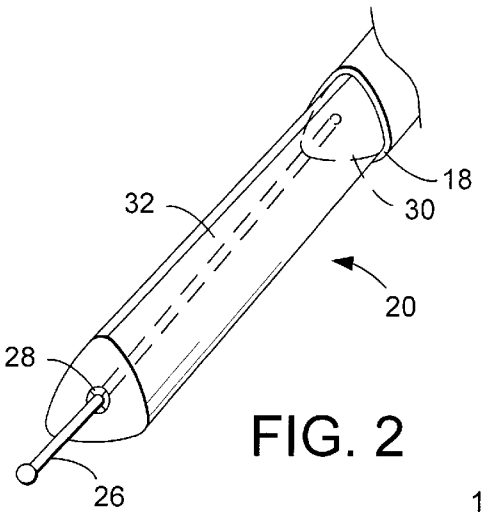
FIG. 2 is an isometric view of an insulator of the sleeping bag of FIG. 1.

Referring to FIG. 1, a sleeping bag according to one preferred embodiment of the present invention is shown generally at 10. Sleeping bag 10 typically includes an outer shell 12 having a plurality of compartments 14. Typically, compartments 14 are filled with down. Alternatively, compartments 14 may be filled with materials known in the sleeping bag arts as Polyfill and Bivy-Seal, or with some other insulating material. An outer surface 16 of shell 12 typically is GORE-TEX® on a bottom region 16*a* and DRYLOFT® on a top region 16*b*. Alternatively, all or part of outer surface 16 may be made of nylon, microfiber, rubber, or other suitable material.

Sleeping bag 10 also typically includes slots 18 into which an insulator 20 may be inserted. Slots 18 typically are positioned adjacent and inward of compartments 14. Slots 18 typically are triangular and extend in an annular direction around sleeping bag 10. Alternatively, slots 18 may be longitudinal, diagonal, curved, or some other predetermined shape. The slots also may extend only part way around bag 10, such as half way around sleeping bag 10. While typically the slots are positioned from head to toe along the entire length of the bag, the slots may alternatively positioned only on a portion of the sleeping bag. The slots are usually layered in an inner layer 18*a* and an outer layer 18*b*. Additional layers may also be included. Alternatively, the sleeping bag may include only one layer of slots, such as inner layer 18*a*. Typically the slots are triangular in shape. Alternatively, the slots may be round, oval, circular, polygonal, or some other predetermined shape suitable to accommodate insulators 20.

Insulator 20 typically includes a lightweight outer skin and a filler material. Insulator 20 may also be referred to as a baffle stuffer 20, insulative insert 20, and batting 20. An outer surface 32 of insulator 20 typically is made of lightweight nylon. Alternatively, the outer surface of insulator 20 may be virtually any other suitable material, such as SPANDEX, GORETEX, etc. Typically, insulator 20 is filled with an insulating filler material such as goose down or Polyfill. Alternatively, virtually any other suitable filler material may be used.

A user may access slots 18 by opening insulation compartment zipper 22, which is separate and distinct from outer zipper 24. Zipper 24 functions to open the sleeping bag to allow the user access into the bag. An insulated draft tube may be provided to prevent cold air leaks along outer zipper 24. Foot zipper 25 is provided to allow a user to ventilate his or her feet while using the sleeping bag. Foot zipper 25 may be provided with an oversized zipper pull 25*a*, shown in FIG. 4, positioned on the inside of the sleeping bag 10 to enable the user to open the zipper 25 with his or her feet from within the bag.

Figure 3:
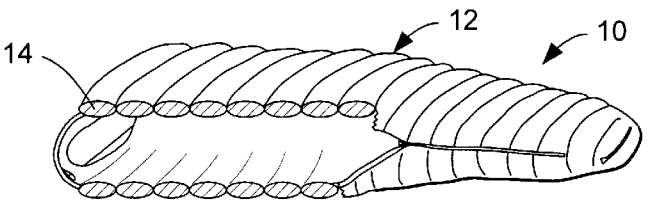
FIG. 3 is a partial cutaway isometric view of a light-insulation configuration of the sleeping bag of FIG. 1, with the insulators removed.

As shown in FIG. 3, the sleeping bag may be used in a light-insulation configuration with only the outer shell as insulation. The light-insulation configuration typically is used during warm weather when less insulation is required to keep the user warm. In the light insulation configuration, compartments 14 are filled with insulation while slots 18*a* and 18*b* are empty.

Figure 4:
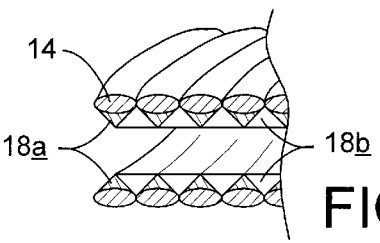
FIG. 4 is a cutaway view of a medium-insulation configuration of the sleeping bag of FIG. 1, with the insulators installed in a predetermined subset of slots.
Figure 5:
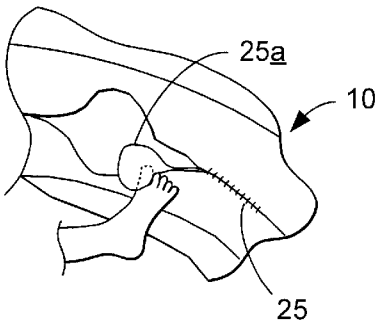
FIG. 5 is a cutaway view of a foot-operated zipper pull of the sleeping bag of FIG. 1.
Figure 6:
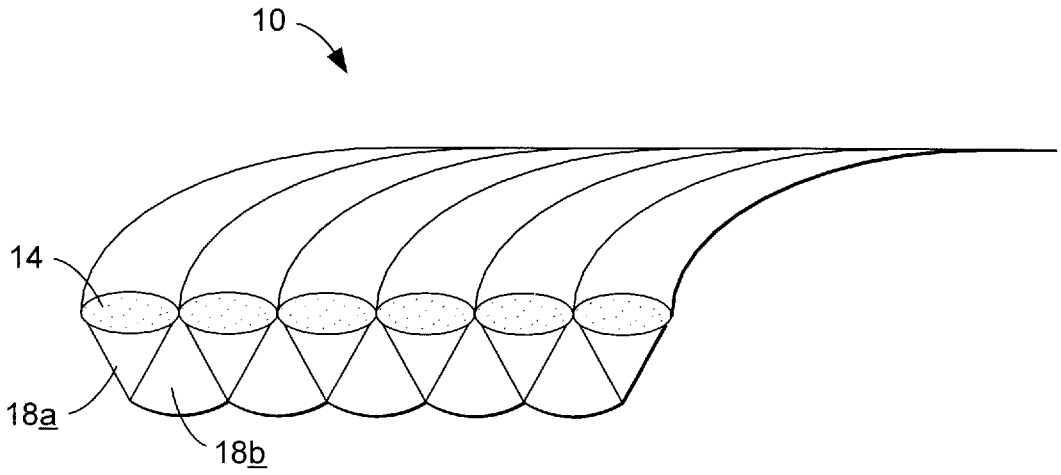
FIG. 6 is a detail cutaway view of the sleeping bag of FIG. 1.
Figure 7:
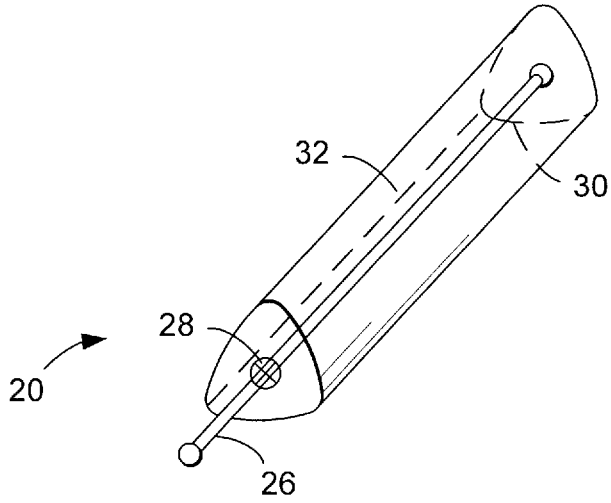
FIG. 7 is an isometric view of an insulator of the sleeping bag of FIG. 1.

When the user desires to utilize the sleeping bag in a colder environment, he or she may insert insulators 20 into slots or sleeves 18 to adjust bag 10 into a medium-insulation configuration, or a heavy-insulation configuration. Typically, the heavy-insulation configuration is formed when a user inserts insulators 20 into both the inner and outer slots 18l 18b for maximum warmth. The medium-insulation configuration typically is formed when the user inserts the insulators 20 into only a predetermined subset of slots 18. Typically, the predetermined subset is all of outer slots 18*b,* such that outer slots 18*b* are filled with insulation, and slots 18*a* are empty, as shown in FIG. 4. Alternatively, the medium-insulation configuration may be formed when the inner slots 18*a* are filled with insulation and outer slots 18*b* are empty, or when some other predetermined subset of slots 18 is filled with insulation. The number and spacing of slots filled with insulation may be varied, to vary the warmth of the medium-insulation configuration. For example, every third slot 18 may be filled, or every fourth slot, etc. In the drawings, the heavy-insulation configuration is shown in FIG. 1, the medium-insulation configuration is shown in FIG. 4, and the light-insulation configuration is illustrated in FIG. 3. The medium-insulation configuration shown in FIG. 4 provides roughly half the insulative capacity of filling all of slots 18 with insulators.

To insert insulators 20 into slots 18 according to one embodiment of the present invention, an insertion tool 26 is provided. Typically, insertion tool 26 is substantially rigid. Preferably, insertion tool 26 is a rigid, yet flexible fiberglass pole, and is collapsible. Alternatively, tool 26 may be metal, plastic, or virtually any other suitable material. Tool 26 is configured to be inserted into insulator 20 through an insertion valve or hole 28. Valve 28 typically is a rubber valve, which allows entry of tool 26 into the insulator 20. The valve is configured to inhibit stuffing within the insulator 20 to leak out of the insulator 20.

Tool 26 passes through insulator 20 until it contacts a back plate 30 of the insulator. Typically, back plate 30 is made of a durable nylon, such as cordura. Back plate 30 may be rigid, and made of plastic or other rigid material. Alternatively, back plate 30 is flexible, and may be made of nylon, or other flexible material.

To insert insulator 20 into compartment 18, a user typically inserts the tool into the slot in the insulator through hole 28 until the tool contacts back plate 30 and, using the tool, pushes the insulator into slot 18 until the insulator is substantially completely inserted. The tool is then removed and stored. In one embodiment of the invention the tool may also be used to support a bivouac over the sleeping bag.

Insulators 20 may be provided in a variety of lengths to accommodate sleeping bags with varying cross-sections from head to toe, and to accommodate varying sizes of sleeping bags. For example, insulators may be provided in large, medium, and small sizes. Typically, the down used in insulator stuffers is 700 or 800 loft goose down. Alternatively, another loft or another type of down may be used. Typically, insulators 20 are slightly longer than slots 18 to ensure a tight fit. As the insulators are inserted, they compress and widen to form an interference fit with slot 18.

Sleeping bag 10 also typically includes a hood 32 equipped with a pillow pouch 34 configured to receive a pillow. Hood 32 typically is equipped with a draw string 36 that allows a user to draw the hood about his or her face and head for added warmth. Sleeping bag 10 also typically includes straps 38 configured to hold a sleeping pad 40 in place under the sleeping bag while in use.

According to the present invention, a user may insert and remove insulators from sleeping bag 10 to adjust the insulative properties of the sleeping bag to accommodate for warmer and cooler sleeping environments, saving the user the cost of buying multiple bags for each season and climate.

While the invention has been disclosed in its preferred form, the specific embodiments thereof as disclosed and illustrated herein are not to be considered in a limiting sense because numerous variations are possible. The subject matter of the invention includes all novel and non-obvious combinations and subcombinations of the various elements, features, functions, and/or properties disclosed herein. No single feature, function, element, or property of the disclosed embodiments is essential. The following claims define certain combinations and subcombinations which are regarded as novel and non-obvious. Other combinations and subcombinations of features, functions, elements, and/or properties may be claimed through amendment of the present claims or presentation of new claims in this or a related application. Such claims also are regarded as included within the subject matter of the present invention, irrespective of whether they are broader, narrower, or equal in scope to the original claims.

I claim:

1. A sleeping bag comprising:

an outer shell;

three or more insulators, each insulator including an outer skin surrounding a filler material; and three or more substantially parallel slots positioned adjacent the outer shell, each of the slots being configured to receive a respective insulator;

wherein the plurality of slots are configured to allow insertion and removal of respective insulators by a user, to selectively adjust the warmth of the sleeping bag.

2. The sleeping bag of claim 1, wherein the outer shell includes a plurality of compartments filled with an insulative material.

3. The sleeping bag of claim 2, wherein the slots are substantially triangular.

4. The sleeping bag of claim 1, wherein the insulators each are configured to be inserted into a respective slot using an insertion tool.

5. The sleeping bag of claim 4, wherein each insulator includes a valve configured to receive the insertion tool.

6. The sleeping bag of claim 5, where each valve is configured to inhibit the filler material from exiting each respective insulator.

7. The sleeping bag of claim 1, wherein insertion of the insulators allows the bag to be converted from a light-insulation configuration to a heavy-insulation configuration.

8. The sleeping bag of claim 1, wherein the slots are contained in a compartment that is configured to be repeatedly opened and closed by a user.

9. The sleeping bag of claim 8, wherein the compartment containing the slots is accessible by an insulation compartment zipper.

10. The sleeping bag of claim 1, wherein the slots are positioned adjacent a top region of the outer shell.

11. The sleeping bag of claim 1, wherein the slots are positioned laterally along a longitudinal axis of the sleeping bag.

12. The sleeping bag of claim 1, wherein the slots extend along the entire outer shell.

13. The sleeping bag of claim 1, wherein the outer shell includes a plurality of compartments filled with insulating material, and the slots are positioned interior of the plurality of compartments of the outer shell.

14. The sleeping bag of claim 13, wherein the slots are organized into at least two layers.

15. A sleeping bag comprising:

an outer shell filled with an insulative material;

three or more slots positioned adjacent the outer shell, the slots being configured to be accessed by a user; and three or more substantially parallel insulators, each insulator including an outer skin surrounding a filler material, each of the insulators being sized to be selectively inserted to and removed from a respective slot;

wherein selective insertion and removal of the insulators allows the bag to be converted from a light-insulation configuration to a heavy-insulation configuration.

16. The sleeping bag of claim 15, wherein selective insertion and removal of the insulators allows the bag to be converted to a light-insulation configuration in which insulators are inserted into none of the slots, a medium configuration in which the insulators are inserted into one or more of the slots, and a heavy-insulation configuration in which the insulators are inserted into substantially all of the slots.

17. The sleeping bag of claim 15, wherein the slots are positioned laterally along a longitudinal axis of the sleeping bag.

18. The sleeping bag of claim 17, wherein the slots extend along the entire outer shell.

* * * * *